US006662947B2

(12) United States Patent
Lopez

(10) Patent No.: US 6,662,947 B2
(45) Date of Patent: Dec. 16, 2003

(54) BOX FOR CARRYING BOTTLES

(75) Inventor: Paul M. Lopez, Tulare, CA (US)

(73) Assignee: Georgia-Pacific Corporation, Atlanta, GA (US)

( * ) Notice: Subject to any disclaimer, the term of this patent is extended or adjusted under 35 U.S.C. 154(b) by 86 days.

(21) Appl. No.: 09/965,653

(22) Filed: Sep. 27, 2001

(65) Prior Publication Data

US 2003/0057125 A1 Mar. 27, 2003

(51) Int. Cl.[7] ..... B65D 65/00

(52) U.S. Cl. ..... 206/427; 206/147; 206/168; 229/115; 229/120.23

(58) Field of Search ..... 206/427–435, 206/147, 152, 168, 169, 194, 139; 229/115, 120.23, 120.35

(56) References Cited

U.S. PATENT DOCUMENTS

| | | | | |
|---|---|---|---|---|
| 1,824,762 A | | 9/1931 | Bloom | |
| 2,173,494 A | | 9/1939 | Rous | |
| 2,312,598 A | | 3/1943 | Sprague | |
| 3,352,473 A | * | 11/1967 | Graser | 229/120.27 |
| 3,428,235 A | * | 2/1969 | Randazzo | 206/427 |
| 4,258,847 A | | 3/1981 | Nierman | 206/504 |
| 4,856,652 A | * | 8/1989 | Bowland | 206/223 |
| 5,125,565 A | | 6/1992 | Rogers | 229/115 |
| 5,476,217 A | * | 12/1995 | Moncrief et al. | 229/120.27 |
| 5,558,224 A | * | 9/1996 | Fogle | 206/427 |
| 5,950,831 A | * | 9/1999 | Millet | 206/446 |
| D442,083 S | | 5/2001 | Hoffman et al. | D9/431 |

FOREIGN PATENT DOCUMENTS

| | | | |
|---|---|---|---|
| DE | 2149016 | 4/1973 | B65D/81/02 |
| FR | 2663296 | 6/1990 | B56D/5/10 |
| GB | 1338230 | 2/1970 | B65D/5/50 |

* cited by examiner

*Primary Examiner*—J. Mohandesi
(74) *Attorney, Agent, or Firm*—Banner & Witcoff, Ltd.

(57) ABSTRACT

A box is formed from a blank of foldable material and includes a first wall and a second wall. The second wall is folded about a first wall fold line to form a first box corner. A third wall is folded about a second wall fold line to form a second box corner. A triangular top is folded about a top fold line. A triangular bottom is folded about a bottom fold line. A plurality of apertures is formed in the top. An insert having a plurality of panels is positioned between the first, second and third walls when the walls are folded about the wall fold lines.

21 Claims, 4 Drawing Sheets

BOX FOR CARRYING BOTTLES

FIELD OF THE INVENTION

The present invention is directed to a box, and, more particularly, to a box for carrying bottles.

BACKGROUND OF THE INVENTION

Boxes are typically formed of material, such as corrugated fiberboard, that is die cut into a sheet having a desired shape. Fold lines are scored on the sheet, demarcating separate walls, a top, a bottom, and closure flaps, thus forming a blank. The blank is then folded about the fold lines and the closure flaps are glued, male/female locked, or stapled to the walls, top and bottom, thereby forming a box.

U.S. Pat. No. 2,173,494 to Rous discloses a carton for carrying six bottles. Rous is limiting in that it does not provide for protection between the bottles during transport. U.K. Pat. No. 1,338,230 to Smallwood discloses a case for carrying 10 bottles. Smallwood is limiting in that a fastener, such as adhesive or staples, is required to retain the case in its assembled condition, and no protection is provided between the bottles.

In view of the foregoing it is an object of the present invention to provide a box that reduces or overcomes the aforesaid difficulties inherent in prior known boxes for carrying bottles.

BRIEF SUMMARY OF THE INVENTION

The principles of the invention maybe used advantageously to provide a simple and effective box for carrying bottles that is easy to assemble and disassemble, while at the same time providing protection for the bottles, and which is easy for an individual to carry.

In accordance with a first aspect, a blank of foldable material for forming a box includes a first wall panel, and a second wall panel foldable about a first wall fold line demarcating the first and second wall panels. A third wall panel is foldable about a second wall fold line demarcating the second and third wall panels. One side of a triangular top extends along a top edge of the second wall, and is foldable about a top fold line demarcating the top and the second wall. A plurality of apertures is formed in the top. One side of a triangular bottom extends generally along a bottom edge of the second wall and is foldable about a bottom fold line demarcating the bottom and the second wall. An insert includes a first panel, and a second panel adjacent the first panel and foldable about an insert panel fold line demarcating the first panel and the second panel. A slit in the first panel extends from the insert panel fold line through the first panel and back to the insert panel fold line to form a third panel foldable about the insert panel fold line.

In accordance with another aspect, a box formed from a blank of foldable material includes a first wall and a second wall adjacent the first wall. The second wall is folded about a first wall fold line demarcating the first and second walls to form a first box corner. A third wall adjacent the second wall is folded about a second wall fold line demarcating the second and third walls to form a second box corner. A triangular top extends along a top edge of the second wall and is folded about a top fold line demarcating the top from the second wall. A triangular bottom extends along a bottom edge of the second wall and is folded about a bottom fold line demarcating the bottom from the second wall. A plurality of apertures is formed in the top, with each aperture configured to receive a neck of a bottle. An insert has a plurality of panels folded from of a sheet of material, the insert being positioned between the first, second and third walls when the walls are folded about the wall fold lines.

In accordance with another aspect, a blank of foldable material for forming a box includes a first wall panel and a second wall panel. The second wall panel is foldable about a first wall fold line demarcating the first and second wall panels, to form a first box corner. A third wall panel is foldable about a second wall fold line demarcating the second and third wall panels. A pair of wall tabs extends from a side edge of the first wall panel. A wall closure flap is foldable about a wall closure flap fold line demarcating the wall closure flap and the third wall. A pair of wall tab slots extends generally along the wall closure flap fold line, with each wall tab slot configured to receive a respective wall tab. A triangular top has one side extending along a top edge of the second wall and is foldable about a top fold line demarcating the top and the second wall. A pair of top tabs is also included, with a first top tab projecting from a top edge of the first wall and a second top tab projecting from a top edge of the third wall. A pair of top closure flaps is included as well, with each top closure flap extending along one side of the top and foldable about a top closure flap fold line demarcating the top closure flap from the top. A pair of top slots is included, with each top slot extending generally along one of the top closure flap fold lines and configured to receive a top tab. A triangular bottom has one side extending generally along a bottom edge of the second wall and is foldable about a bottom fold line demarcating the bottom and the second wall. Also included is a pair of bottom tabs, with a first bottom tab projecting from a bottom edge of the first wall and a second bottom tab projecting from a bottom edge of the third wall. Also included is a pair of bottom closure flaps, with each bottom closure flap extending along one side of the bottom and foldable about a bottom closure flap fold line demarcating the bottom closure flap from the bottom. A pair of bottom slots is also included, with each bottom slot extending generally along one of the bottom closure flap fold lines and configured to receive a bottom tab. An insert includes a first panel and a second panel. The second panel of the insert is adjacent the first panel and folded about an insert panel fold line demarcating the first panel and the second panel. A slit in the first panel extends from the insert panel fold line through the first panel and back to the insert panel fold line to form a third panel foldable about the insert panel fold line. The insert is positioned between the first, second and third walls when the walls are folded about the wall fold lines.

Those skilled in the art will appreciate that preferred embodiments of the present invention can provide a box for carrying bottles that is easy to assembly and disassemble, provides a simple and efficient device for protecting the bottles from one another, as well as being easy to carry. These and additional features and advantages of the invention will be readily apparent and fully understood from the following detailed description of preferred embodiments, taken with reference to the appended drawings.

DETAILED DESCRIPTION OF THE INVENTION

Figure 1:
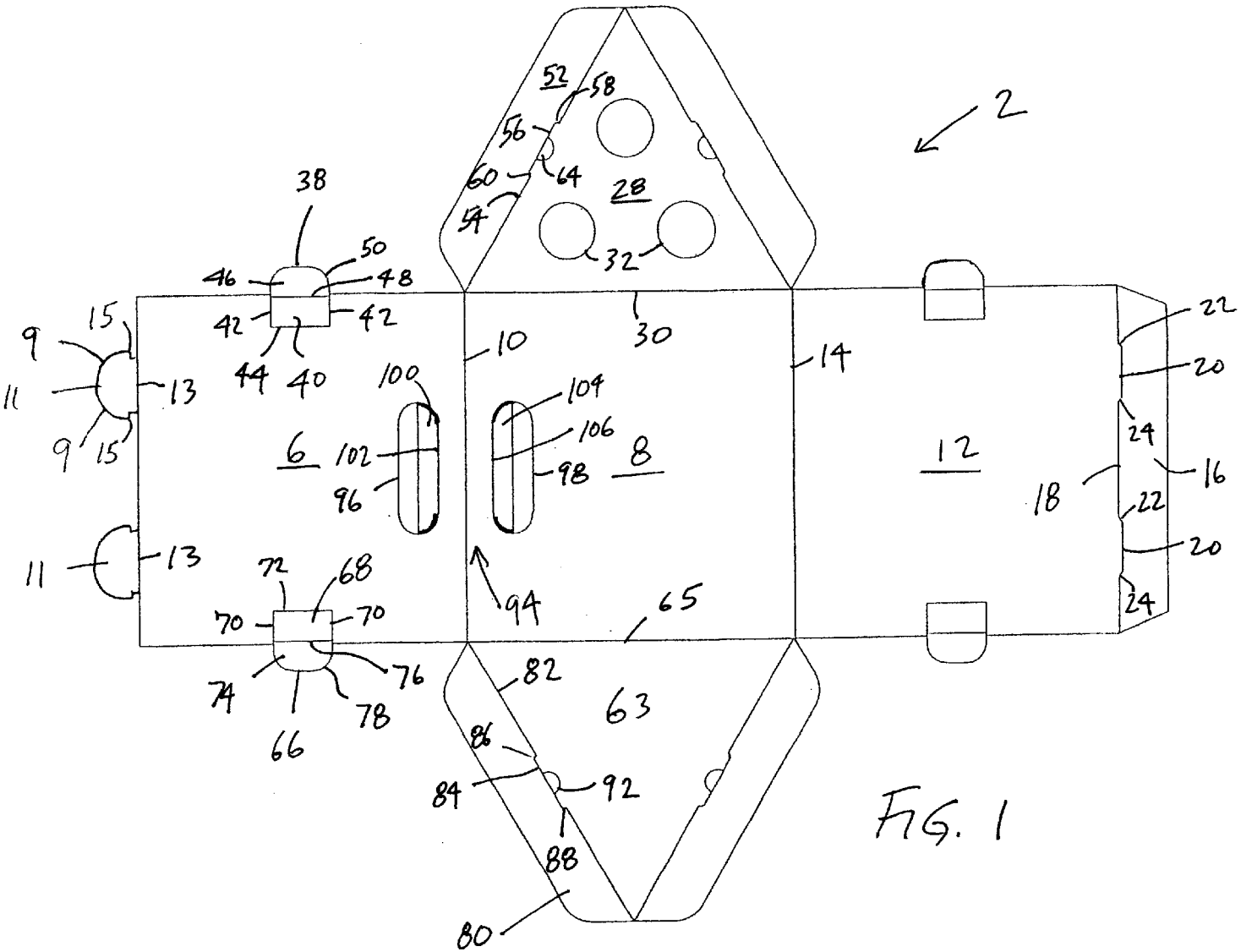
FIG. 1 is a plan view of a box precursor in accordance with a preferred embodiment of the present invention.

As shown in FIG. 1, a box precursor or blank 2 in accordance with the present invention comprises a sheet that is die cut to a desired size. In a preferred embodiment, blank 2 is formed of corrugated fiberboard. Blank 2 may also be formed of folding carton, chip board, or any other material suitable for carrying the contents of the box such as, for example, bottles. Blank 2, when folded, will form a box-shaped container 4 as seen in FIG. 2 and described more fully below.

Figure 2:
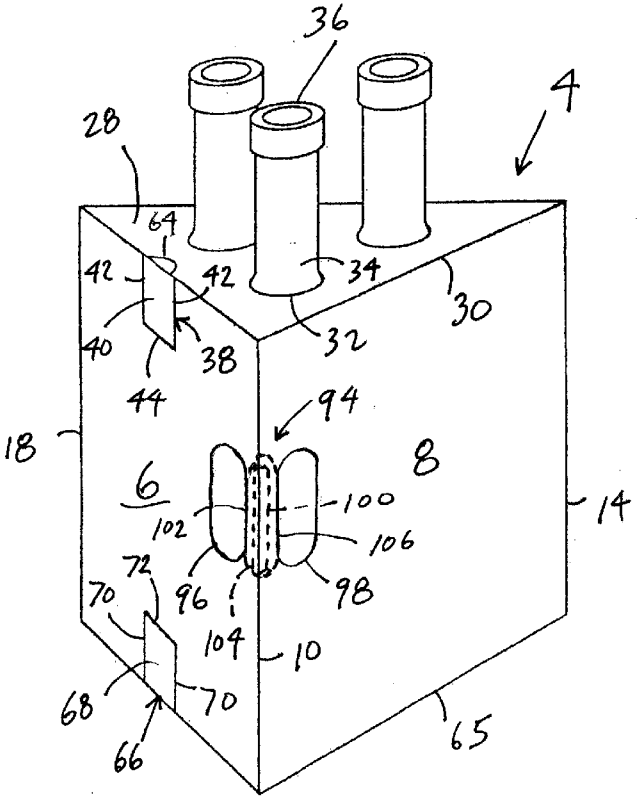
FIG. 2. is a perspective view of a box formed from the box precursor of FIG. 1, shown carrying three bottles.

The terms top, bottom and side, as used herein, are relative terms and refer generally to box 4 as illustrated in FIG. 2, with bottles protruding upwardly out of the box as seen here. It is to be appreciated that other orientations of box 4 are considered to be within the scope of the invention. For example, in one orientation where the user holds the box by its handle and the bottles protrude horizontally out of the box, the top and bottom would not refer to vertical directions, and in such a case could be considered to be end panels.

Blank 2 includes a first wall panel 6, separated or demarcated from an adjacent second wall panel 8 by a first wall fold line 10. A wall fold line, commonly referred to in the industry as a "score," is a partially compressed region of blank 2 formed by scoring, which facilitates the folding of blank 2. A third wall panel 12 is similarly demarcated from adjacent second wall panel 8 by a second wall fold line 14. Wall fold lines 12, 14 form corners of a three-sided box 4, as seen in FIG. 2.

A pair of wall tabs 11 (tabs are commonly referred to in the industry as "male locks") are formed along a side edge of first wall 6, and are separated or demarcated from first wall panel 6 by a wall tab fold line 13. In the illustrated embodiment, wall tabs 11 have rounded or radiused corners 9 that provide for easy insertion of wall tabs in slots 20, described in greater detail below. In other preferred embodiments, corners 9 may be chamfered or otherwise modified to facilitate insertion of wall tabs 11 in slots 20. In certain preferred embodiments, notches in wall tabs 11 at the juncture of wall tabs 11 and wall tab fold line 13 form barbs 15. Barbs 15 maintain wall tabs 11 in their engaged position within slots 20, as described in greater detail below.

Figure 3:
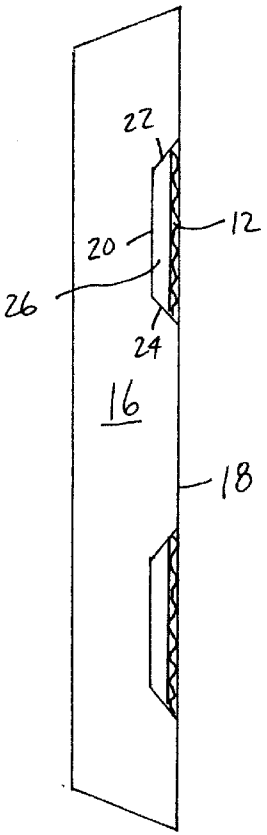
FIG. 3 is an elevation view of a wall closure flap of the box precursor of FIG. 1 in its folded position.

A flange or wall closure flap 16 extends along a side edge of third wall panel 12, and is similarly separated or demarcated from third wall panel 12 by a wall closure flap fold line 18. A pair of slots 26, seen in FIG. 3 and commonly referred to in the industry as "female slots," are formed generally along wall closure flap fold line 18. As seen in FIG. 1, each slot 26 is formed by a plurality of slits formed in blank 2. A slit 20 in wall closure flap 16 extends generally parallel and proximate to wall closure flap fold line 18. A first end slit 22 extends from a first end of slit 20 to wall closure flap fold line 18. A second end slit 24 extends from a second end of slit 20 to wall closure flap fold line 18. Each slit 20 and its corresponding end slits 22, 24 form a slot 26, as seen in FIG. 3. Slots 26 receive wall tabs 11 when box 4 is assembled, and the engagement of wall tabs 11 in slots 26 serves to maintain the walls of box 4 in their folded state. In certain preferred embodiments, end slits 22, 24 extend at an angle with respect to wall closure flap fold line 18. In the illustrated embodiment, end slits 22, 24 are angled outwardly from slit 20 toward the top and bottom of third wall panel, respectively, such that slot 26 has a generally trapezoidal shape. It is to be appreciated that more or less than two wall tabs 11 and corresponding slots 26 may be formed along first wall panel 6 and third wall panel 12.

As seen in FIG. 1, a triangular end or top panel 28 extends along an edge (seen as an upper edge in the illustrated embodiment) of second wall panel 8, and is demarcated from second wall panel 8 by a top fold line 30 extending along the length of the upper edge of second wall panel 8. One or more cut outs or apertures 32 are formed in top panel 28. As seen in FIG. 2, apertures 32 are seen to receive the necks 34 of bottles 36 carried within box 4. In the illustrated embodiment, three bottles 36 are carried in box 4, and, consequently, three apertures 32 are formed in top panel 28.

A top tab 38 is formed along an edge (seen as an upper edge in the illustrated embodiment) of each of first wall panel 6 and third wall panel 12. A first portion 40 of top tab 38 is formed by a pair of slits 42, extending downwardly from the upper edge of the respective wall panel to a first top tab fold line 44 about which first portion 40 may be folded. A second portion 46 extends upwardly from the upper edge of its respective wall panel, and is separated or demarcated from first portion 40 by a second top tab fold line 48. Top tab fold line 48 preferably extends just below and parallel to the upper edge of its respective wall panel. Slits 42 preferably extend generally parallel to one another and perpendicular to the upper edge of the respective wall panel. In the illustrated embodiment, second portion 46 has rounded or radiused corners 50 that provide for easy insertion of top tabs 38 in slots 62, as further described below. In other preferred embodiments, corners 50 may be chamfered or otherwise modified to facilitate insertion of top tabs 38 in slots 62.

Figure 4:
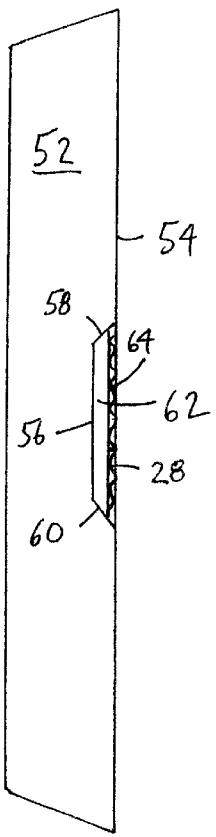
FIG. 4 is an elevation view of a top closure flap of the box precursor of FIG. 1 in its folded position.
Figure 5:
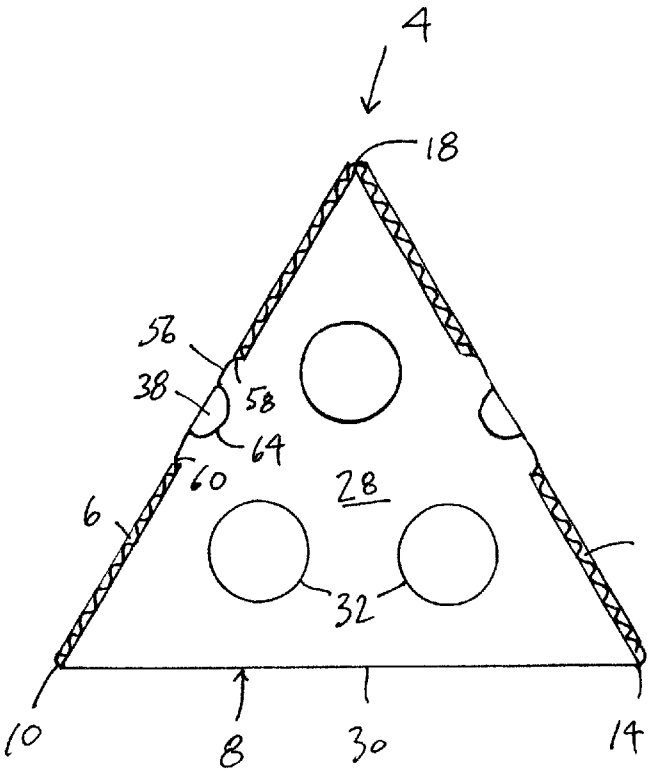
FIG. 5 is a plan view of the box of FIG. 2.

A top flange or closure flap 52 extends along each side edge of top panel 28, and is similarly separated or demarcated from top panel 28 by a top closure flap fold line 54. A slit 56 is formed in top closure flap 52, and extends generally parallel and proximate to top closure flap fold line 54. A first end slit 58 extends from a first end of slit 56 to top closure flap fold line 54. A second end slit 60 extends from a second end of slit 56 to top closure flap fold line 54. Each slit 56 and its corresponding end slits 58, 60 form a slot 62, as seen in FIG. 4. Slots 62 receive respective top tabs 38 when box 4 is assembled as seen in FIG. 5, and serve to maintain top panel 28 of box 4 in its folded state.

Cut outs or apertures 64 are formed in top panel 28, with each aperture opening into a corresponding slot 62. Apertures 64 serve to provide access to top tabs 38 when top panel 28 is in its folded state, as seen in FIG. 5, allowing an individual to grasp top tabs 38 with a finger and release them from engagement with slots 62. Such access to top tabs 38 facilitates disassembly of box 4. In the illustrated embodiment, apertures 64 have a semi-circular shape. Other suitable shapes will become readily apparent to those skilled in the art, given the benefit of this disclosure.

In certain preferred embodiments, end slits 58, 60 extend at an angle with respect to top closure flap fold line 54. In the illustrated embodiment, end slits 58, 60 are angled outwardly from slit 56 toward top closure flap fold line 54, such that slot 62 has a generally trapezoidal shape, as seen in FIG. 4. It is to be appreciated that more than one top tab 38 and corresponding slot 62 may be formed along first wall 6 and top closure flap 52.

As seen in FIG. 1, a triangular end or bottom panel 63 extends along an edge (seen as a lower edge in the illustrated embodiment) of second wall panel 8, and is demarcated from second wall panel 8 by a bottom fold line 65 extending along the length of the lower edge of second wall panel 8.

A bottom tab 66 is formed along an edge (seen as a lower edge in the illustrated embodiment) of each of first wall panel 6 and third wall panel 12. A first portion 68 of top tab 66 is formed by a pair of slits 70, extending upwardly from the lower edge of the respective wall panel to a first bottom tab fold line 72 about which first portion 68 may be folded. A second portion 74 extends downwardly from the lower edge of its respective wall panel, and is separated or demarcated from first portion 68 by a second bottom tab fold line 76. Bottom tab fold line 76 preferably extends just above and parallel to the lower edge of its respective wall panel. Slits 70 preferably extend generally parallel to one another and perpendicular to the lower edge of the respective wall panel. In the illustrated embodiment, second portion 74 has rounded or radiused corners 78 that provide for easy insertion of bottom tabs 66 in slots 90 as further described below. In other preferred embodiments, corners 78 may be chamfered or otherwise modified to facilitate insertion of bottom tabs 66 in slots 90.

Figure 6:
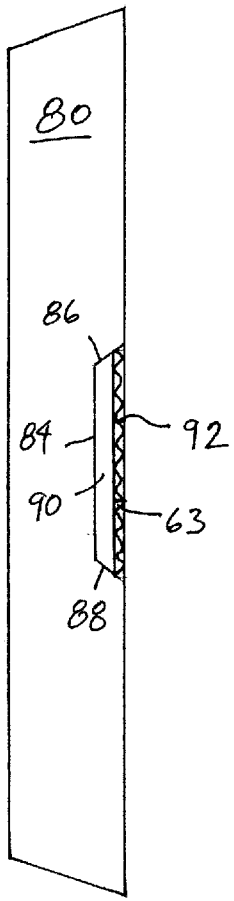
FIG. 6 is an elevation view of a bottom closure flap of the box precursor of FIG. 1 in its folded position.

A bottom flange or closure flap 80 extends along each side edge of bottom panel 63, and is similarly separated or demarcated from bottom panel 63 by a bottom closure flap fold line 82. A slit 84 is formed in bottom closure flap 80, and extends generally parallel and proximate to bottom closure flap fold line 82. A first end slit 86 extends from a first end of slit 84 to bottom closure flap fold line 82. A second end slit 88 extends from a second end of slit 84 to bottom closure flap fold line 82. Each slit 84 and its corresponding end slits 86, 88 form a slot 90, as seen in FIG. 6. Slots 90 receive bottom tabs 66 when box 4 is assembled, and serve to maintain bottom panel 63 of box 4 in its folded state.

Cut outs or apertures 92 are formed in bottom panel 63, with each aperture opening into a corresponding slot 90. Apertures 92 serve to provide access to bottom tabs 66 when bottom panel 63 is in its folded state as seen in FIG. 6, allowing an individual to grasp bottom tabs 66 with a finger and release them from engagement with slots 90. Such access facilitates disassembly of box 4, allowing an individual to easily access the bottles carried in the box. In the illustrated embodiment, apertures 92 have a semi-circular shape. Other suitable shapes will become readily apparent to those skilled in the art, given the benefit of this disclosure.

In certain preferred embodiments, end slits 86, 88 extend at an angle with respect to bottom closure flap fold line 82. In the illustrated embodiment, end slits 86, 88 are angled outwardly from slit 84 toward bottom closure flap fold line 82, such that slot 90 has a generally trapezoidal shape, as seen in FIG. 6. It is to be appreciated that more than one bottom tab 66 and corresponding slot 90 may be formed along bottom panel 63 and bottom closure flap 80.

As seen in FIGS. 1 and 2, a handle 94 is formed in box 4. Handle 94 includes a first aperture 96 formed in first wall panel 6 and a second aperture 98 formed in second wall 8. Apertures 96 and 98 are preferably oval, or racetrack shaped, with semi-circular ends connected by straight sides. A handle flap 100 is positioned within aperture 96, and is separated or demarcated from first wall panel 6 by a handle flap fold line 102. Similarly, a handle flap 104 is positioned within aperture 98, and is separated or demarcated from second wall panel 8 by a handle flap fold line 106. Handle flaps 100, 104 have the shape of a half oval, or half racetrack, with a long axis of the racetrack shaped apertures forming the straight sides of the flaps, which are the sides of the flaps remote from the handle flap fold lines 102, 106.

When box 4 is in its assembled state, as seen in FIG. 2, handle flaps 100, 104 are bent into the interior of box 4 about handle flap fold lines 102, 106, respectively, in overlapping fashion. The handle flaps thus provide a comfortable resting place for an individual's fingers extending through apertures 96, 98 of handle 94 when carrying box 4.

Figure 9:
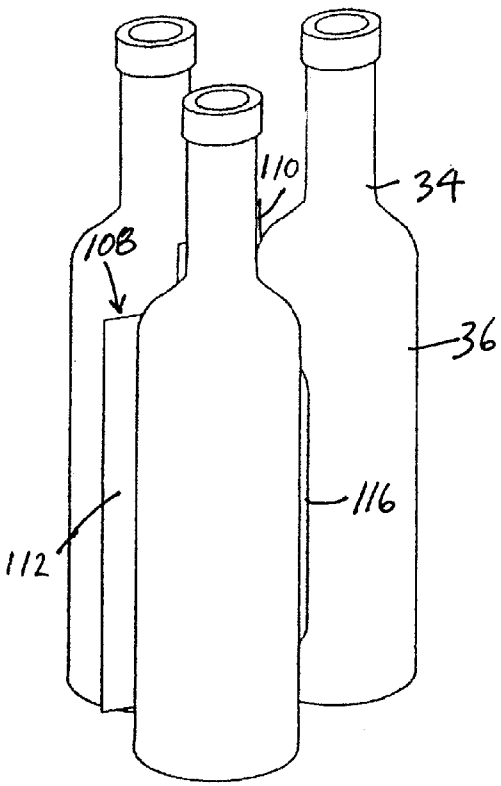
FIG. 9 is a perspective view of the insert of FIG. 8, shown in its folded position between three bottles.
Figure 8:
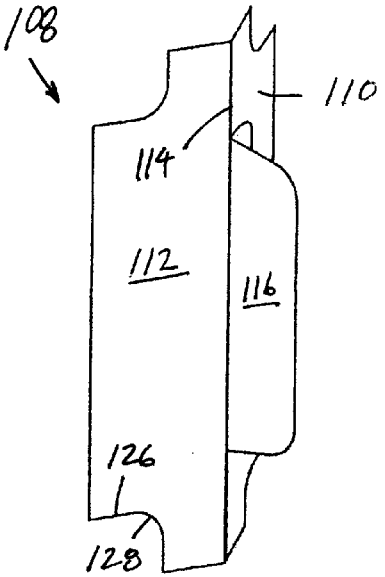
FIG. 8 is a perspective view of an insert formed from the insert precursor of FIG. 7, shown in its folded position as used when inserted into the box of FIG. 2.
Figure 7:
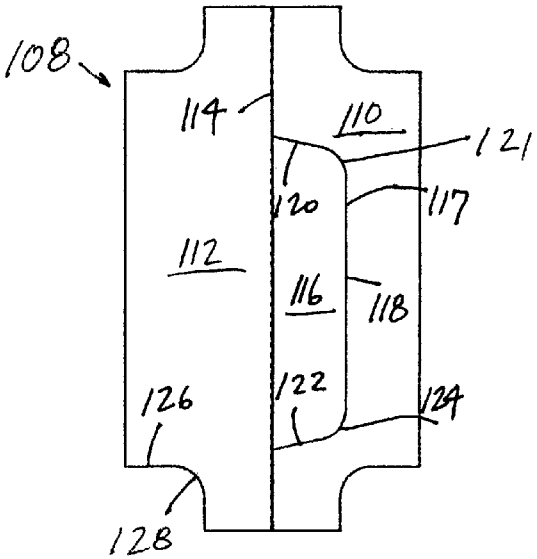
FIG. 7 is a plan view of an insert precursor for insertion in the box of FIG. 2.

As seen in FIGS. 7–8, an insert 108 is formed of a sheet of material. Insert 108 may be formed of, for example, corrugated fiberboard, folding carton, chip board, or any other material suitable for providing protection between bottles within the box. Insert 108 includes a first insert panel 110, and a second insert panel 112 separated or demarcated from first insert panel 110 by an insert panel fold line 114. A third insert panel 116 is formed as a part of first insert panel 110 by a slit 117 that extends from insert panel fold line 114 through first insert panel 110 and back to insert panel fold line 114. Slit 117 includes a first portion 118 that is spaced from and generally parallel to insert panel fold line 114. A second portion 120 extends from a first end of first portion 118 to insert panel fold line 114. Second portion 120 is joined to first portion 118 by rounded corner 121. A third portion 122 extends from a second end of first portion 118 to insert panel fold line 114. Third portion 122 is joined to first portion 118 by rounded corner 124. In use, insert panels 110 and 112 are folded toward one another until they are approximately 120° apart. Third insert panel is then folded about insert panel fold line 114 away from first panel 110 and toward second panel 112 until it is approximately 120° from first insert panel 110 and second insert panel 112. Insert 108 fits between three bottles 36, as seen in FIG. 9, providing protection for the bottles from one another as they are carried in box 4. Notches 126 having rounded corners 128 are formed in the corners of first insert panel 110 and second insert panel 112, and facilitate the insertion of insert 108 between bottles 36, or the insertion of bottles 36 into box 4 between the respective panels of insert 108. Insert 108 is advantageously formed from a single sheet of material, die-cut into its proper shape, thereby easing manufacture of the insert, and, consequently, reducing the costs associated with its manufacture.

As noted above, blank 2 may be formed of corrugated fiberboard. In certain preferred embodiments the direction of the corrugation runs generally perpendicular to wall fold lines 10 and 14, providing for easier scoring of the wall fold lines. Similarly, in certain preferred embodiments the direction of corrugation of insert 108 is generally perpendicular to insert fold line 114. However, it is to be appreciated that the direction of corrugation of blank 2 and insert 108 may extend in any direction.

To form box 4 from blank 2, first wall panel 6 and second panel 8 are folded toward one another about first wall fold line 10, and third panel 12 and second panel 8 are folded toward one another about second wall fold line 14. Wall closure flap 16 is then folded in toward first wall panel 6. Wall tabs 11 are folded in toward wall closure flap 16 and third wall panel 12 and inserted into respective slots 26. At this point, the three walls of the box have been formed, with adjacent walls spaced apart at an angle of approximately 60°. The engagement of barbs 15 with wall closure flap 16 prevents wall tabs 11 from inadvertently coming out of slots 26, thereby ensuring that box 4 retains its shape and the bottles remain in the box.

Top closure flaps 52 are then folded inwardly about top closure flap fold lines 54 toward the walls. Top panel 28 is folded downwardly toward the walls about top closure flap fold lines 54 such that top closure flaps 52 are received between the walls, and top closure flap fold lines 54 are adjacent and generally parallel to the top edges of first and third wall panels 6, 12. Top tabs 38 are then inserted into slots 62, thereby retaining top panel 28 in its use position. Three bottles 36 are then placed in box 4, with necks 34 of bottles 36 protruding through and received by apertures 32. Insert 108 is positioned between the panels, one of first, second and third panels 110, 112, 116 extending between each of adjacent bottles in box 4. It is to be appreciated that insert 108 can be placed in box 4 before any bottles 36 are placed in the box, or after one or two bottles are placed in the box.

Bottom closure flaps 80 are then folded inwardly about bottom closure flap fold lines 82 toward the walls. Bottom panel 63 is folded upwardly toward the walls about bottom fold line 65 such that bottom closure flaps 80 are received between the walls, and bottom closure flap fold lines 82 are adjacent and generally parallel to the bottom edges of first and third wall panels 6, 12. Bottom tabs 66 are then inserted into slots 90, thereby retaining bottom 63 in its use position. Handle flaps 100, 104 are then folded in toward the interior of box 4, and the box can then easily be carried by an individual.

Removal of bottles 36 from box 4 is accomplished by first removing bottom tabs 66 from slots 90. By inserting a finger into an aperture 92, an individual can easily grasp a bottom tab 66 and slide it out of a corresponding slot 90. Once bottom tabs are free of slots 90, bottom 63 can be unfolded about bottom fold line 63, allowing access to bottles 36. Box 4 may then be completely disassembled by removing top tabs 38 from top slots 62, unfolding top 28 about top fold line 30, removing wall tabs 11 from wall slots 26 and unfolding the wall panels. Box 4 can be assembled again at any time in the manner described above.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

In light of the foregoing, those skilled in the art will readily understand that various modifications and adaptations can be made without departing from the scope and spirit of the invention as defined in the appended claims.

I claim:

1. A blank of foldable material for forming a box, comprising:

a first wall panel;

a second wall panel foldable about a first wall fold line demarcating the first and second wall panels;

a third wall panel foldable about a second wall fold line demarcating the second and third wall panels;

a triangular top extending along a top edge of the second wall panel and foldable about a top fold line demarcating the top and the second wall panel;

a plurality of apertures formed in the top;

a triangular bottom extending along a bottom edge of the second wall panel and foldable about a bottom fold line demarcating the bottom and the second wall panel; and an insert comprising:

a first panel;

a second panel adjacent the first panel and foldable about an insert panel fold line demarcating the first panel and the second panel; and a slit in the first panel, the slit extending from the insert panel fold line through the first panel and back to the insert panel fold line to form a third panel foldable about the insert panel fold line.

2. The blank according to claim 1, further comprising a wall closure flap extending along a side edge of the third wall panel and foldable about a wall closure flap fold line demarcating the wall closure flap and the third wall panel.

3. The blank according to claim 2, further comprising:

at least one wall tab projecting from a side edge of the first wall panel; and at least one slot extending generally along the wall closure flap fold line, each slot configured to receive a wall tab.

4. The blank according to claim 3, wherein each slot is formed by a first slit in the wall closure flap extending generally parallel to and proximate the wall closure flap fold line, a second slit extending from a first end of the first slit to the wall closure flap fold line, and a third slit extending from a second end of the first slit to the wall closure flap fold line.

5. The blank according to claim 4, wherein the second and third slits extend at an angle with respect to the wall closure flap fold line such that each slot has a trapezoidal shape when the wall closure flap is folded about the wall closure flap fold line.

6. The blank according to claim 1, wherein three apertures are formed in the top.

7. The blank according to claim 1, further comprising a pair of top closure flaps, each top closure flap extending along an edge of the top and foldable about a top closure flap fold line demarcating the top closure flap and the top.

8. The blank according to claim 7, further comprising:

at least one top tab along a top edge of each of the first and third wall panels; and at least one top tab slot extending generally along each top closure flap fold line, each top tab slot configured to receive a top tab.

9. The blank according to claim 8, wherein each top tab comprises a first portion formed by a pair of slits extending from a top edge of its respective wall panel to a first top tab fold line about which the first portion is foldable, and a second portion extending outwardly from the top edge of its respective wall panel and foldable about a second top tab fold line demarcating the first portion and the second portion.

10. The blank according to claim 8, further comprising at least one top tab aperture, each top tab aperture formed in the top and opening into a corresponding top tab slot.

11. The blank according to claim 10, wherein each top tab aperture has a generally semi-circular shape.

12. The blank according to claim 8, wherein each top tab slot is formed by a slit in a top closure flap and having a first portion extending along the top closure flap generally parallel to a corresponding top closure flap fold line, a second portion extending from a first end of the first portion to the corresponding top closure flap fold line, and a third portion extending from a second end of the first portion to the corresponding top closure flap fold line.

13. The blank according to claim 1, further comprising a pair of bottom closure flaps, each bottom closure flap extending along an edge of the bottom and foldable about a bottom closure flap fold line demarcating the bottom closure flap and the bottom.

14. The blank according to claim 13, further comprising:

at least one bottom tab along a bottom edge of each of the first and third wall panels; and at least one bottom tab slot extending generally along each bottom closure flap fold line, each bottom tab slot configured to receive a bottom tab.

15. The blank according to claim 14, wherein each bottom tab comprises a first portion formed by a pair of slits extending from a bottom edge of its respective wall panel to a first bottom tab fold line about which the first portion is foldable, and a second portion extending outwardly from the bottom edge of its respective wall panel and foldable about a second bottom tab fold line demarcating the first portion and the second portion.

16. The blank according to claim 14, further comprising at least one bottom tab aperture, each bottom tap aperture formed in the bottom and opening into a corresponding bottom tab slot.

17. The blank according to claim 16, wherein each bottom tab aperture has a generally semi-circular shape.

18. The blank according to claim 14, wherein each bottom tab slot is formed by a slit in a bottom closure flap and having a first portion extending along a bottom closure flap generally parallel to a corresponding bottom closure flap fold line, a second portion extending from a first end of the first portion to the corresponding bottom closure flap fold line, and a third portion extending from a second end of the first portion to the corresponding bottom closure flap fold line.

19. A blank according to claim 1, wherein the blank is formed of corrugated fiberboard.

20. A box formed from a blank of foldable material, said box comprising:

a first wall;

a second wall adjacent the first wall and folded about a first wall fold line demarcating the first and second walls to form a first box corner;

a third wall adjacent the second wall and folded about a second wall fold line demarcating the second and third walls to form a second box corner;

a triangular top extending along a top edge of the second wall and folded about a top fold line demarcating the top from the second wall;

a triangular bottom extending along a bottom edge of the second wall and folded about a bottom fold line demarcating the bottom from the second wall;

a plurality of apertures formed in the top, each aperture configured to receive a neck of a bottle; and an insert having a plurality of panels folded from a sheet of material, the insert being positioned between the first, second and third walls when the walls are folded about the wall fold lines;

wherein the insert comprises:

a first panel;

a second panel adjacent the first panel and folded about a panel fold line demarcating the first panel and the second panel; and a slit in the first panel, the slit extending from the insert panel fold line through the first panel and back to the insert panel fold line to form a third panel folded about the insert panel fold line.

21. A blank of foldable material for forming a box, comprising:

a first wall panel and a second wall panel foldable about a first wall fold line demarcating the first and second wall panels;

a third wall panel foldable about a second wall fold line demarcating the second and third wall panels;

a pair of wall tabs extending from a side edge of the first wall panel;

a wall closure flap foldable about a wall closure flap fold line demarcating the wall closure flap and the third wall panel;

a pair of wall tab slots extending generally along the wall closure flap fold line, each wall tab slot configured to receive a respective wall tab;

a triangular top extending along a top edge of the second wall panel and foldable about a top fold line demarcating the top and the second wall panel;

a pair of top tabs, a first top tab projecting from a top edge of the first wall panel and a second top tab projecting from a top edge of the third wall panel;

a pair of top closure flaps, each top closure flap extending along one side of the top and foldable about a top closure flap fold line demarcating the top closure flap from the top;

a pair of top slots, each top slot extending generally along one of the top closure flap fold lines and configured to receive a top tab;

a triangular bottom extending along a bottom edge of the second wall panel and foldable about a bottom fold line demarcating the bottom and the second wall panel;

a pair of bottom tabs, a first bottom tab projecting from a bottom edge of the first wall panel and a second bottom tab projecting from a bottom edge of the third wall panel;

a pair of bottom closure flaps, each bottom closure flap extending along one side of the bottom and foldable about a bottom closure flap fold line demarcating the bottom closure flap from the bottom;

a pair of bottom slots, each bottom slot extending generally along one of the bottom closure flap fold lines and configured to receive a bottom tab; and an insert comprising:

a first panel;

a second panel adjacent the first panel and foldable about an insert panel fold line demarcating the first panel and the second panel; and a slit in the first panel, the slit extending from the insert panel fold line through the first panel and back to the insert panel fold line to form a third panel foldable about the insert panel fold line.

* * * * *